United States Patent [19]

Edmond et al.

[11] 4,281,723

[45] Aug. 4, 1981

[54] CONTROL SYSTEM FOR A DRILLING APPARATUS

[75] Inventors: Tibor O. Edmond; Henry A. Bourne, Jr., both of Ponca City, Okla.

[73] Assignee: Conoco, Inc., Ponca City, Okla.

[21] Appl. No.: 123,540

[22] Filed: Feb. 22, 1980

[51] Int. Cl.[3] ..... E21B 7/08

[52] U.S. Cl. ..... 175/76; 175/61; 175/62; 175/94

[58] Field of Search ..... 175/61, 62, 73–80, 175/94, 98, 99, 257, 75, 320; 299/31

[56] References Cited

U.S. PATENT DOCUMENTS

| | | | |
|---|---|---|---|
| 3,043,381 | 7/1962 | McNeely, Jr. | 175/61 |
| 3,437,380 | 4/1969 | Lawrence | 299/31 |
| 4,040,494 | 8/1977 | Kellner | 175/73 |

*Primary Examiner*—William F. Pate, III

*Attorney, Agent, or Firm*—Richard W. Collins

[57] ABSTRACT

An improved deflecting device is provided for a drilling apparatus having a rotatable drill shaft extending from a power source through said deflection device to a drill bit. The deflection device includes an outer housing affixed to the power source and extending axially therefrom. An inner ring is disposed within the housing and encompasses a portion of the drill shaft. An intermediate ring is disposed between the outer housing and the inner ring and has an inner configuration such that the inner ring is immovable relative to the intermediate ring in a first direction, and is prevented from rotating relative to said intermediate ring about an axis parallel to a second direction perpendicular to said first direction, and such that said inner ring is movable relative to the intermediate ring in said second direction. The intermediate ring is movable in the first direction relative to the outer housing, and is prevented from rotating relative to said outer housing about an axis parallel to said first direction. First and third opposed hydraulic rams are provided for positioning the intermediate ring relative to the outer housing in the first direction. Second and fourth opposed hydraulic rams are provided to position the inner ring relative to the intermediate ring in the second direction. A sequencing valve selectively directs hydraulic fluid under pressure to any one of said first, second, third and fourth hydraulic rams or to any transverse pair of said hydraulic rams.

32 Claims, 14 Drawing Figures

CONTROL SYSTEM FOR A DRILLING APPARATUS

BACKGROUND OF THE INVENTION

1. Field of the Invention

The present invention relates generally to directional control systems for drilling apparatus, and more particularly, but not by way of limitation, to directional control systems particularly suited for controlling a substantially horizontally oriented drill shaft and bit.

2. Brief Description of the Prior Art

Horizontal drilling generally requires three essential features: first, a drill; second, a means of forcing the drill into the ground; and third, a means of controlling the drill during its underground operation. The guidance systems used for controlling the underground operation of a drill generally comprise two types. The first type includes surface generated signals and means for conveying the surface generated signals to the horizontal drill. The second type includes underground sensing means provided in the drill for sensing its position and controlling its position in response to said sensed signals.

With either of the above mentioned types of control systems, a deflection device is utilized to deflect the drill in the desired direction in response to the control signals.

One particularly significant advance in such deflection devices is shown in U.S. Pat. No. 3,888,319 to Bourne, Jr., et al., assigned to the assignee of the present invention. The Bourne, Jr., et al. device includes a roll control mechanism in combination with a deflection device. The roll control mechanism comprises a unit which is actuated by pistons which operate on a ratchet assembly. The ratchet assembly provides a means of transmitting the movement of the roll control mechanism to the outside body of the drill. The deflection unit is mounted near the drill bit and comprises a single shoe which is forced against the drill hole wall in any positiion necessary to provide force against the drill, thereby controlling its direction. The same hydraulic system provides both operation of the roll control mechanism and the deflection unit.

The present invention describes an alternative form of deflection device for use with a control system like that of Bourne, Jr., et al., which eliminates the need for a roll control mechanism.

The deflection device of the present invention is similar in some respects to that disclosed in U.S. Pat. No. 3,437,380 to Lawrence, as particularly shown in FIG. 9 thereof. Both Lawrence and the present invention disclose an outer housing, a first deflecting means utilizing hydraulic rams for movement in a first direction relative to the outer housing, and a second deflecting means utilizing hydraulic rams for movement in a second direction relative to the first deflecting means. The first and second directions are perpendicular.

The present invention, however, provides numerous improvements over the rudimentary disclosure of Lawrence. Significantly, the present invention includes first and second guide means which allow movement of the first and second deflecting means in said first and second directions, while preventing rotation about axes parallel to said first and second directions and preventing movement in said second and first directions, relative to said outer housing and said first deflecting means, respectively.

BRIEF DESCRIPTION OF THE INVENTION

The present invention includes a deflection device for a drilling apparatus having a rotatable drill shaft extending from a power source through said deflection device to a drill bit. The deflection device includes an outer housing affixed to the power source and extending axially therefrom. An inner ring is disposed within the housing and encompasses a portion of the drill shaft. An intermediate ring is disposed between the outer housing and the inner ring and has an inner configuration such that the inner ring is immovable relative to the intermediate ring in a first direction, and is prevented from rotating relative to said intermediate ring about an axis parallel to a second direction perpendicular to said first direction, and such that said inner ring is movable relative to the intermediate ring in said second direction. The intermediate ring itself is movable in the first direction relative to the outer housing, and is prevented from rotating relative to said outer housing about an axis parallel to said first direction. A first positioning means is provided for positioning the intermediate ring relative to the outer housing in the first direction, and a second positioning means is provided for positioning the inner ring relative to the intermediate ring in the second direction. The first and second positioning means are simultaneously operable so that the inner ring can be deflected in any direction relative to the outer housing. Sequencing valve means is provided for selectively directing hydraulic fluid under pressure to any one of said first, second, third and fourth hydraulic rams or to any transverse pair of said hydraulic rams.

It is, therefore, a general object of the present invention to provide an improved deflection device for a drilling apparatus.

Another object of the present invention is to provide an improved valve means for selectively directing hydraulic fluid under pressure to any one or any transverse pair of hydraulic rams of a deflection device having first, second, third and fourth rams.

Numerous other objects, features and advantages of the present invention will be readily apparent to those skilled in the art upon a reading of the following disclosure when taken in conjunction with the accompanying drawings.

DETAILED DESCRIPTION OF THE PREFERRED EMBODIMENTS

Figures 1, 2, 3, 12:
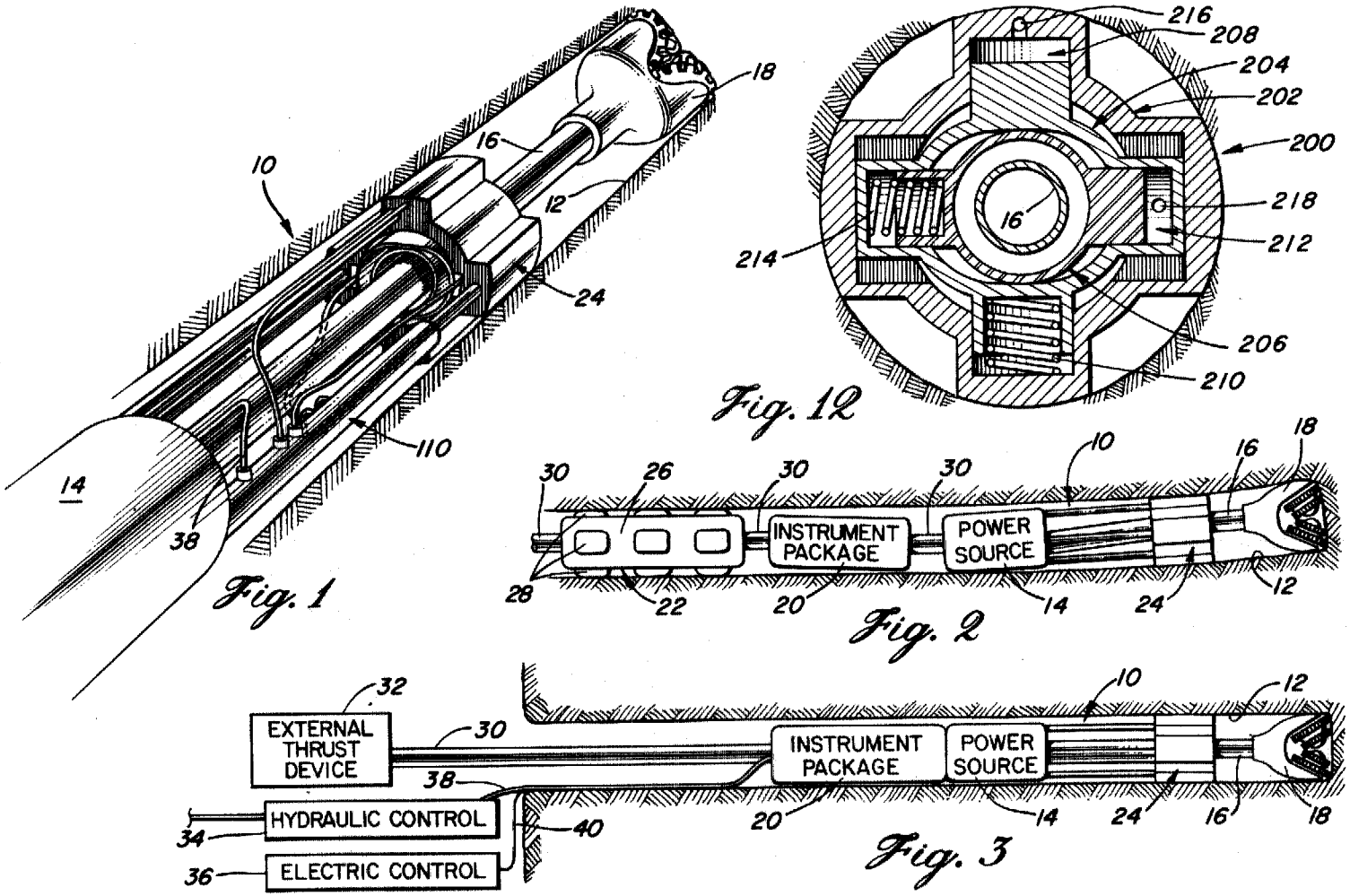
FIG. 1 is a perspective view showing a drilling apparatus, with the deflection device of the present invention, in place within a bore hole in the earth.
FIG. 2 is a side view of the drilling apparatus of FIG. 1 in place within a bore hole, and also schematically illustrates a thrust device and instrumentation package connected to the drilling apparatus.
FIG. 3 is another embodiment of the apparatus of FIG. 2 designed for use with an external thrust device and externally located hydraulic and electrical controls.
FIG. 12 is a sectional view similar to FIG. 6, illustrating an alternative embodiment of the deflection device.

Referring now to the drawings and particularly to FIG. 1, a drilling apparatus is shown and generally designated by the numeral 10. The drilling apparatus 10 is shown in place within a bore hole 12 in the earth.

The drilling apparatus 10 includes a power source 14 which preferably comprises either an electric or hydraulic motor for rotating a rotatable drill shaft 16. Attached to the forward end of drill shaft 16 is a drill bit 18 which forms the bore hole 12 as it is rotated and forced into the earth.

The mechanisms for forcing the drilling apparatus 10 into the earth are generally the same as those disclosed in detail in U.S. Pat. No. 3,888,319 to Bourne, Jr., et al., which is incorporated herein by reference. FIGS. 2 and 3 briefly illustrate the means for forcing the drilling apparatus 10 into the earth and some of the means for controlling the drilling apparatus 10 which are disclosed in more detail in U.S. Pat. No. 3,888,319.

FIG. 2 illustrates an instrument package 20 and a thrust device 22 connected in that order behind the drilling apparatus 10 within the bore hole 12.

The contents of the instrument package 20 will vary depending upon the particular type of control system which is used to control a deflection device 24 which guides the drilling apparatus 10. The instrument package 20 may include apparatus for receiving signals from the surface and may also include sensing equipment for sensing the position of the drilling apparatus 10.

The thrust device 22 includes a hydraulic cylinder 26 which has a plurality of radially extending pressure feet 28 attached to the outside thereof. The pressure feet 28 are adapted to be hydraulically forced against the inner wall of bore hole 12 when the thrust device 22 is applying pressure to drilling apparatus 10 to force it into the earthen formation. The pressure feet 28 are released when it is desired to move the thrust device 22 within the bore hole 12.

Located behind thrust device 22, and not shown in these illustrations, is an anchoring unit for use with the thrust device 22 which includes a second set of pressure feet similar to the pressure feet 28. That anchoring unit is similar to the unit shown in FIG. 1 of U.S. Pat. No. 3,888,319.

A shaft 30 extends both forwardly and rearwardly from thrust device 22 and the anchor device (not shown). The instrument package 20 and the drilling apparatus 10 are all attached to shaft 30. A hydraulic piston (not shown) is mounted within hydraulic cylinder 26 and rigidly attached to shaft 30.

To force the drilling apparatus 10 forward within bore hole 12, the pressure feet 28 are radially extended to hold the thrust device 22 in place within bore hole 12 and then the hydraulic cylinder 26 forces the shaft 30 forward relative to thrust device 22 thereby forcing drilling apparatus 10 forward. During this mode of operation, the thrust feet (not shown) of the rearward anchor device (not shown) are retracted. When the hydraulic cylinder 26 has reached the forward end of its stroke, the pressure feet (not shown) of the rearward anchor device (not shown) are extended to anchor the anchor device within bore hole 12, and the pressure feet 28 of thrust device 22 are retracted. Then the hydraulic cylinder 26 moves the thrust device 22 forward relative to shaft 30 which is held in place by the rearward anchor device (not shown). Then the cycle is repeated and it can be seen that the drilling apparatus 10 is forced forward within the bore hole 12 by repeatedly carrying out of the steps just described.

The drilling apparatus 10 may also be utilized with an external thrust device 32 such as is schematically illustrated in FIG. 3 of the application. The external thrust device 32 may be constructed in a fashion similar to that illustrated in U.S. Pat. No. 3,888,319 at FIGS. 15–17 thereof.

FIG. 3 also illustrates externally located hydraulic controls 34 and externally located electrical controls 36. Hydraulic controls 34 and electrical controls 36 are connected to instrument package 20 and drilling apparatus 10 by hydraulic connecting line 38 and electrical connecting line 40, respectively.

The details of drilling apparatus 10, and particularly of deflection device 24, are best shown in FIGS. 4–7. The deflection device 24 includes an outer housing 42 which is affixed to power source 14 by a plurality of longitudinal support members 44. Outer housing 42 is adapted to be closely received within borehole 12 formed by drill bit 18. Outer housing 42 extends axially from power source 14 and is disposed about and parallel to the longitudinal axis of drill shaft 16.

An inner ring 46 is disposed within outer housing 42 and encompasses a portion of drill shaft 16. An intermediate ring 48 is disposed between outer housing 42 and inner ring 46.

Intermediate ring 48 may also be referred to as a first deflecting means 48, and inner ring 46 may be referred to as a second deflecting means 46.

Outer housing 42 includes a cylindrical housing portion 50 having first, second, third and fourth radially outward extending arms 52, 54, 56 and 58. The radially outer surfaces of arms 52, 54, 56 and 58 are arcuately shaped and constructed for closely engaging the inner surface of bore hole 12. First and third arms 52 and 56 are diametrically opposed. Second and fourth arms 54 and 58 are diametrically opposed, perpendicular to arms 52 and 56.

The second and fourth arms 54 and 58 of outer housing 42 each have disposed in their radially inner surfaces vertically extending slots 60 and 62, respectively. First and third arms 52 and 56 each have disposed in their inner surfaces, radially extending bores 64 and 66, respectively.

First deflecting means 48 includes an oval shaped tubular ring or body 68, which oval has a maximum cross sectional outer dimension approximately equal to the inner diameter of cylindrical portion 50 of outer housing 42. An axis through the cross section of oval body 68 coincident with its maximum diameter is defined as a length axis 70 of oval body 68. The oval shape cross section is defined by two semi-circular ends 61 and 63 (See FIG. 5), joined by two straight sides 65 and 67 (see FIG. 5) which are parallel to length axis 70.

The first deflecting means 48 is spring centered between the hydraulic cylinders of first and third arms 52 and 56 by centering springs 82 and 84, so that in the absence of any force being exerted by either of said first and third hydraulic rams the first deflecting means 48 is vertically centered within housing 42. Spring 84 is particularly sized for opposing the gravitational force acting downwardly on shaft 16. Hydraulic fluid is communicated to and from bores 64 and 66 through ports 86 and 88, respectively.

Figure 5:
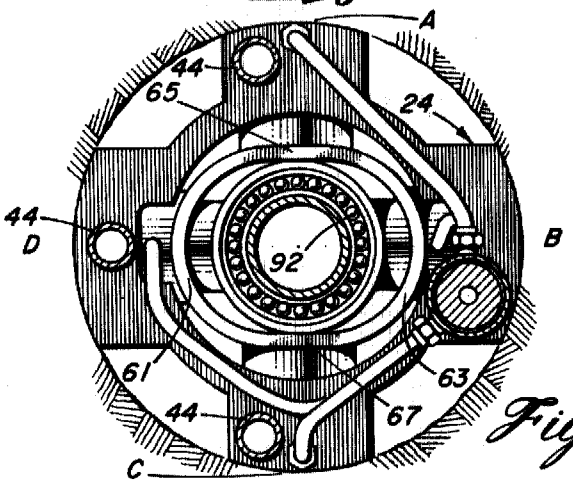
FIG. 5 is a sectional view along line 5—5 of FIG. 4.
Figure 11:
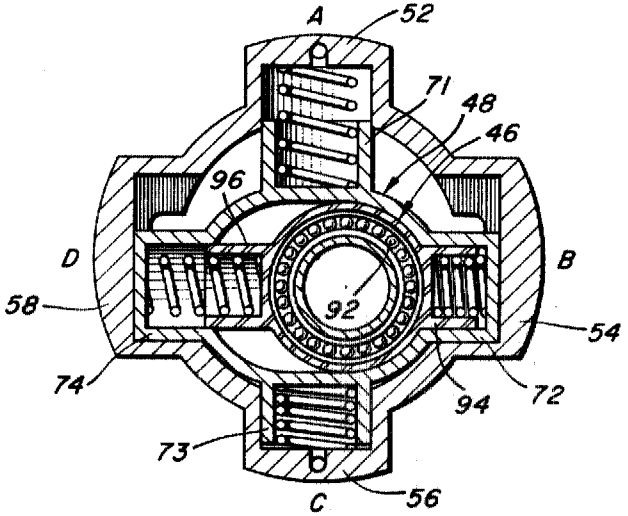
FIG. 11 is a view similar to FIG. 10 showing the orientation of the components of the deflection device when the upper and the left cylinders are fully extended.
Figure 10:
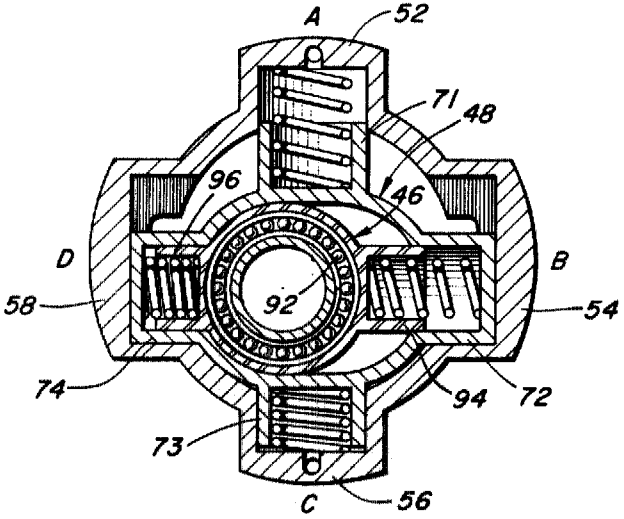
FIG. 10 is a sectional view similar to FIG. 6 illustrating the position of the various components of the deflection device when the upper and right hydraulic cylinders are fully extended.

Second deflecting means 46 includes a cylindrical tubular ring or body 90 disposed around drill shaft 16. As is shown in FIGS. 5, 10 and 11, a bearing means 92 is generally disposed between cylindrical body 90 and shaft 16. The tubular cylindrical body 90 engages and deflects shaft 16 through the bearing 92.

Figure 6:
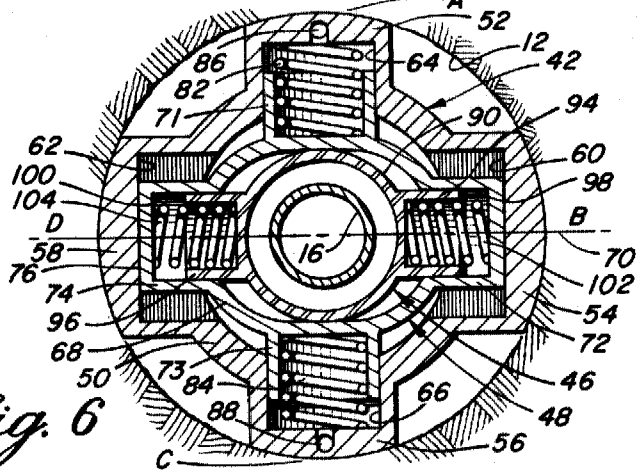
FIG. 6 is a sectional view along line 6—6 of FIG. 4.
Figure 7:
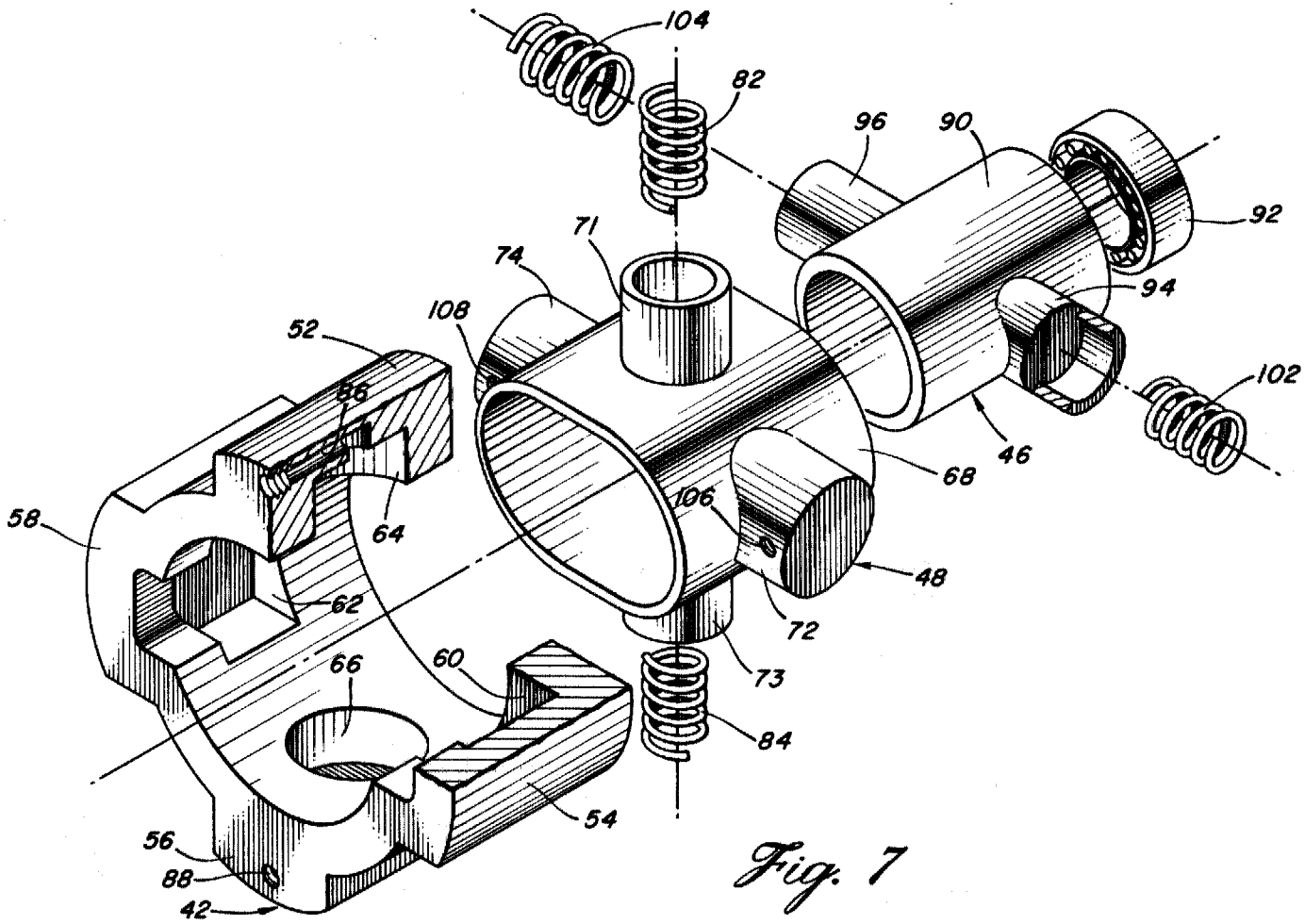
FIG. 7 is an exploded partially cut away schematic view of the deflection device.

Cylindrical body 90 has an outer diameter slightly less than a minimum inner diameter of oval shaped body 68 so that tubular body 90 is closely received within oval shaped body 68. The oval shaped inner configuration of oval shaped body 68 is such that cylindrical body 90 of second deflecting means 46 is immovable relative to first deflecting means 48 in a first direction, which in FIGS. 4–7, 10 and 11 is illustrated as being a vertical direction, and is movable relative to first deflecting means 48 in a second direction perpendicular to said first direction. This second direction is a horizontal direction parallel to the axis 70 as shown in FIG. 6. The axial lengths of cylindrical body 90 and oval shaped body 68, as best seen in FIG. 7, also prevent second deflecting means 46 from rotating relative to first deflecting means 48 about a horizontal axis.

It will of course be understood that the outer housing 42 could be rotated to any desired orientation so that the first and second directions do not necessarily have to be vertical and horizontal. In a preferred embodiment of the invention, however, the first and second directions are vertical and horizontal.

Extending radially outward from cylindrical tubular member 90 of second deflecting means 46 are first and second cylindrical members 94 and 96 thereof, which are closely received in radial bores 98 and 100 of second and fourth cylindrical portions 72 and 74 of first deflecting means 48.

Cylindrical members 94 and 96 of second deflecting means 46, and bores 98 and 100 of first deflecting means 48, form second and fourth hydraulic rams, respectively, with cylindrical members 94 and 96 functioning as pistons with bores 98 and 100.

The first and third rams in first and third arms 52 and 56 may be referred to as a first positioning means adapted to position first deflecting means 48 relative to outer housing 42 in said first direction. The second and fourth rams disposed in second and fourth arms 54 and 58 provide a second positioning means adapted to position second deflecting means 46 relative to first deflecting means 48 in said second direction. Any two non-opposed rams, e.g., the first and second rams, may be referred to as a transverse pair of rams.

Cylindrical tubular body 90 is spring centered between the cylinders formed by bores 98 and 100 by springs 102 and 104.

Hydraulic fluid is conducted to and from bores 98 and 100 through ports 106 and 108, respectively (See FIG. 7).

Figure 4:
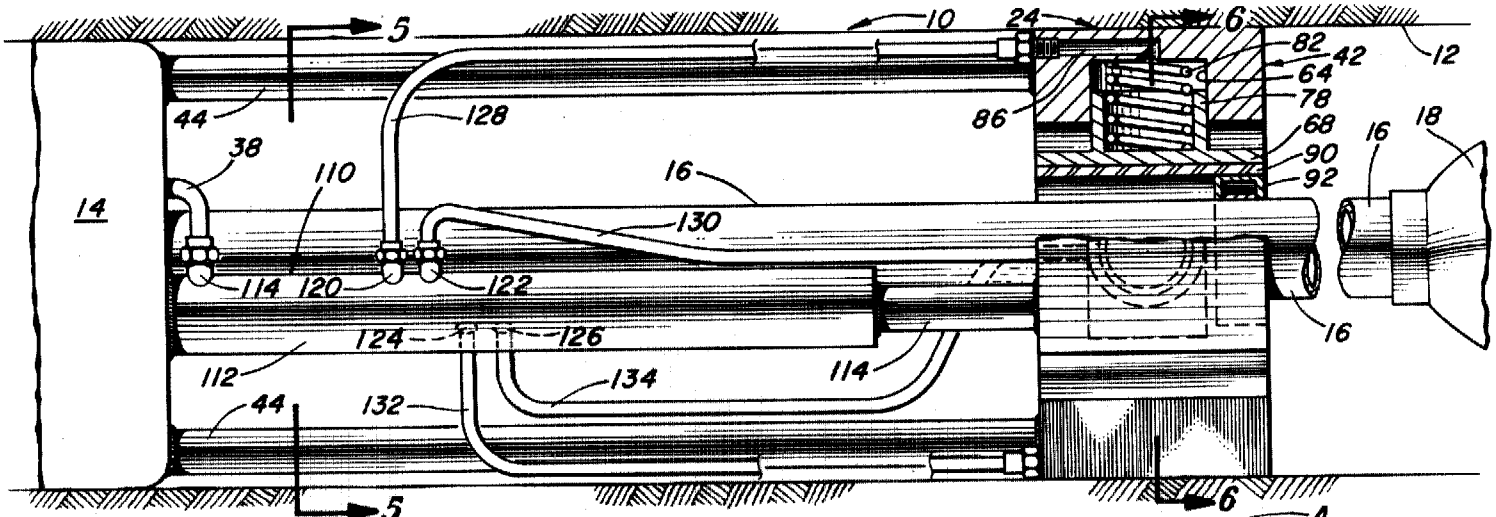
FIG. 4 is an enlarged side elevation, partially cut away, view of the apparatus of FIG. 1, particularly illustrating the hydraulic connections between the deflection device and its control system.

The deflection device 24 includes a valve means generally designated by the numeral 110 for selectively directing hydraulic fluid under pressure to any one of four hydraulic rams or to any transverse pair of hydraulic rams. An external view of valve means 110 is shown in FIG. 1 and 4. Valve means 110 includes a cylindrical outer body 112 which, along with a stub portion 14, provides an additional longitudinal support member similar to the longitudinal support members 44 between power source 14 and outer housing 42 of deflection device 24.

Figure 8:
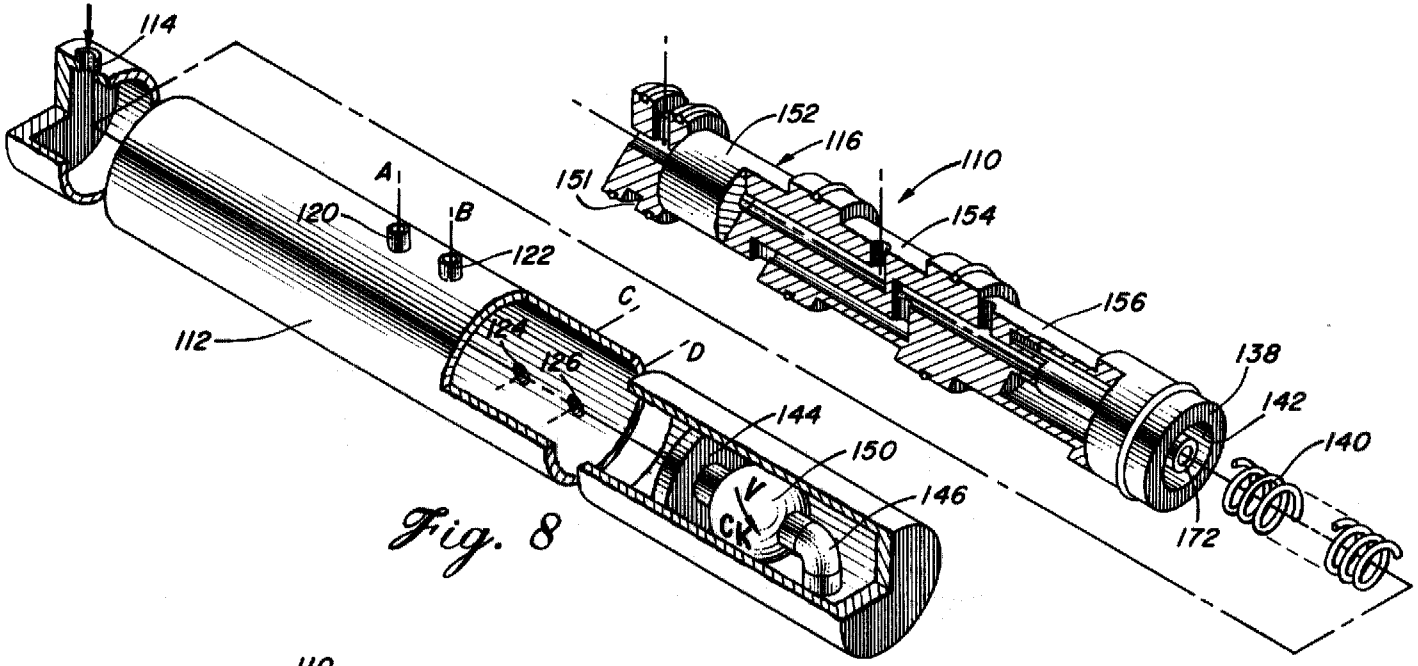
FIG. 8 is an exploded partially cut away view of the control valve for the deflection device.
Figure 9:
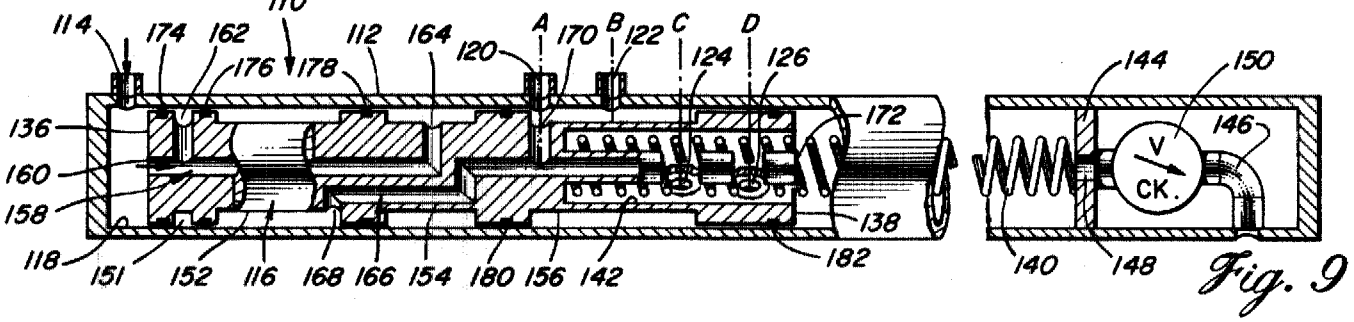
FIG. 9 is a side elevation partly sectioned schematic view of the control valve of FIG. 8.

Valve means 110 is best illustrated in FIG. 8 and 9. Cylindrical body 112 includes an inlet port 114 which receives hydraulic fluid under pressure from hydraulic supply line 38 which is connected to the hydraulic controls 34 at the ground surface as shown in FIG. 3.

A sliding valve spool 116 is reciprocably disposed within an inner bore 118 of valve body 112 and is movable therein in order to selectively direct fluid to and from any one, or any transverse combination of two, of first, second, third and fourth power ports 120, 122, 124 and 126.

To aid in the understanding of and the correlation of the drawings, ports 120, 122, 124 and 126 have been labeled with alphabetic indications A, B, C and D, respectively. Accordingly, the hydraulic ram on the deflection device 24 to which each of the power ports is connected is also labeled with the same alphabetic indications A, B, C and D so that is may be readily seen in the various views which rams are connected to which power ports of valve means 110. The designations A, B, C and D apply to the first, second, third and fourth hydraulic rams disposed in first, second, third and fourth arms 52, 54, 56 and 58, respectively, of outer housing 42.

First power port 120 is connected by a hydraulic conduit 128 to port 86 of first arm 52 of outer housing 42. Second power port 122 is connected by conduit 130 to port 106 in the second radially extending cylindrical portion 72 of first deflecting means 48. Third power port 124 is connected by conduit 132 to port 88 in third arm 56 of outer housing 42. Fourth power port 126 is connected by conduit 134 to port 108 in fourth radially extending cylindrical portion 74 of first deflecting means 48.

Valve spool 116 is a cylindrical member having a first end 136 exposed to the pressure of hydraulic fluid introduced through port 114 and having a second end 138. A coil biasing spring 140 has a first end received within an annular cavity 142 within second end 138 of spool 116 and has a second end engaging a support means 144 fixed within valve body 112.

That portion of valve body 112 within which second end 138 of valve spool 116 is received is in fluid communication with a hydraulic fluid return line 146 through orifice 148 in support means 144 and check valve 150.

The position of valve spool 116 within valve body 112 is determined by the pressure introduced at inlet port 114. That pressure is exerted against first end 136 of valve spool 116. The second end 138 of valve spool 116 is exposed to the exhaust pressure from whichever of the hydraulic rams is not being extended, so that the hydraulic pressure on second end 138 is generally lower than that on first end 136. The biasing spring 140 initially biases valve spool 116 to the left, as shown in FIG. 9. As the pressure introduced at inlet port 114 is increased, the pressure differential acting longitudinally across valve spool 116 overcomes the biasing force of spring 140 and moves valve spool 116 further to the right.

Cylindrical valve spool 116 has first, second, third and fourth reduced outer diameter portions 151, 152, 154 and 156, respectively. A hydraulic supply passage means 158 is disposed in valve spool 116 and includes an inlet 160 at first end surface 136 of valve spool 116, a first outlet 162 communicating with first reduced diameter surface 151, and a second outlet 164, communicating with third reduced diameter surface 154.

A hydraulic return passage means 166 is disposed in valve spool 116 and includes a first inlet 168 communicating with second reduced diameter surface 152, a second inlet 170 communicating with fourth reduced diameter surface 156, and an outlet 172 communicating with second end 138 of valve spool 116.

First and second annular O-ring seal means 174 and 176 are disposed between valve spool 116 and inner bore 118 of valve body 112 on either side of first reduced diameter portion 151.

A third resilient O-ring seal 178 is disposed between valve spool 116 and valve body 112 between second and third reduced diameter portions 152 and 154. A fourth O-ring seal 180 is disposed between valve spool 116 and valve body 112 between third and fourth reduced diameter portions 154 and 156. A fifth O-ring seal 182 is disposed between valve spool 116 and valve body 112 between fourth reduced diaemter portion 156 and second end 138.

The valve spool 116 is so dimensioned and constructed that the following alignment of parts occurs as the valve spool 116 is moved to the right relative to valve body 112 as seen in FIG. 9.

Initially, the biasing force of spring 140 is sufficient to retain valve spool 116 in its leftmost position as specifically illustrated in FIG. 9, so that the supply passage means 158 is not communicated with any of the power ports 120, 122, 124 or 126.

As the pressure introduced at inlet port 114 is increased, valve spool 116 is moved to the right in a first longitudinal direction until first power port 120 comes into communication with third reduced diameter portion 154 of valve spool 116, so that hydraulic fluid is ported through supply passage means 158 to first power port 120 and from power port 120 through conduit 128 to port 86. This will move first deflecting means 48 downward relative to outer housing 42. Fluid from within bore 66 of third arm 56 of housing 42 will be ported out port 88 through conduit 132 into port 124 adjacent fourth reduced diameter surface 156 of valve spool 116 and into inlet 170 of return passage means 166 which then directs the return fluid to return conduit 146.

An additional increase in pressure to inlet port 114 moves valve spool 116 further to the right so that both first and second power ports 120 and 122 are in communication with third reduced and diameter surface 154 and hydraulic fluid is then ported from supply passage means 158 to first and second power ports 120 and 122. This alignment of first passage means 158 with first and second power ports 120 and 122 is shown in FIG. 10*a* and a corresponding position of the deflection device 24 is shown in FIG. 10.

The fluid directed to port 122 goes through conduit 130 to port 106 in second cylindrical radially extending portion 72 of first deflecting means 48. This deflects second deflecting means 46 to the left, as shown in FIG. 10 relative to first deflecting means 48.

As the second deflecting means is moved to the left, hydraulic fluid from within bore 100 is directed through port 108 back through conduit 134 into fourth power port 126, and then around fourth reduced diameter surface 156 into inlet 170 of fluid return passage means 166.

Figure 10A:
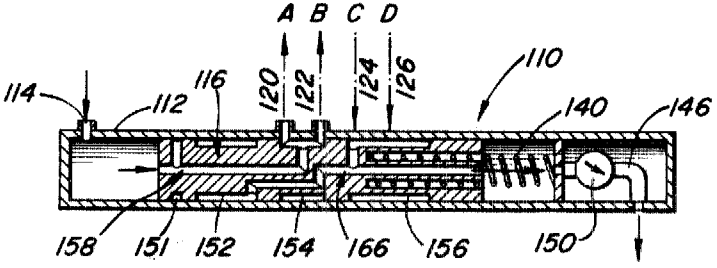
FIG. 10*a* illustrates the orientation of the control valve corresponding to the position of the deflection device shown in FIG. 10.

A further increase in pressure directed to inlet port 114 moves valve spool 116 further to the right, from the position shown in FIG. 10*a*, so that only the second power port 122 is in fluid communication with third reduced diameter surface 154.

Further movement of valve spool 116 to the right places both second and third power ports 122 and 124 in fluid communication with third reduced diameter surface 154 of valve spool 116. The hydraulic fluid directed to third power port 124 goes through conduit 132 to port 88 in third arm 56 of outer housing 42. This drives first deflecting means 48 upwards relative to outer housing 42. Fluid returning from bore 64 of first arm 52 through port 86 and conduit 128 into port 120 then flows around second reduced diameter surface 152 into inlet 168 of return passage means 166.

Still further movement of valve spool 116 to the right moves third reduced diameter surface 154 to a position that only third power port 124 receives hydraulic fluid from supply passage means 158.

Still further movement of valve spool 116 to the right places both third and fourth power ports 124 and 126 in communication with third reduced diameter surface 154 so that they receive fluid from supply passage means 158. The fluid directed to fourth power port 126 flows through conduit 134 to port 108 of fourth cylindrical extension 74 of first deflecting means 48. This drives second deflecting means 46 to the right relative to first deflecting means 48. Return fluid from bore 98 goes through port 106 and through conduit 130 to second power port 122, then around second reduced diameter surface 152 into inlet 168 of fluid return passage means 166.

Figure 11A:
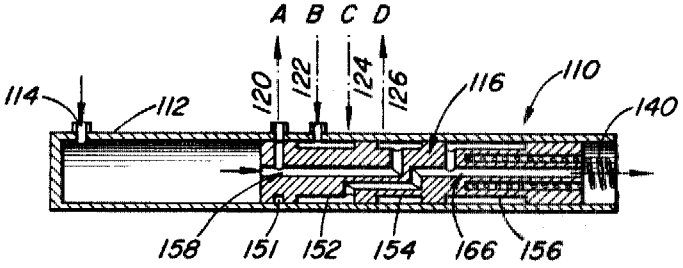
FIG. 11*a* shows the orientation of the control valve corresponding to the position of the deflection device shown in FIG. 11.

Finally, still further movement of valve spool 116 to the right due to increased pressure at inlet 114 moves valve spool 116 to the position illustrated in FIG. 11*a* so that first power port 122 is in fluid communication with first reduced diameter surface 151 so as to receive fluid under pressure from supply passage means 158 through first outlet 162, and fourth power port 126 is in fluid communication with third reduced diameter surface 154. Return fluid flows through conduits 130 and 132 to power ports 122 and 124, then around second reduced diameter surface 152 and into inlet 168 of return passage means 166. In this position the drill shaft 16 is deflected down and to the right as shown in FIG. 11.

The eight positions just described of the valve spool 116 correspond to the eight different directions of deflection of drill shaft 16, said directions beginning with vertically downward and then progressing sequentially clockwise by angular steps of 45°.

Referring now to FIG. 12, an alternative embodiment of deflection device 24 is thereshown and generally indicated by the numeral 200. Deflection device 200 includes outer housing 202, first deflecting means 204, and second deflecting means 206.

Deflection device 200 differs from deflection device 24 in that deflection device 200 includes a single vertically oriented hydraulic ram 208 biased by a spring 210, rather than a pair of opposed vertical rams. Similarly, deflection device 200 includes a single horizontally oriented ram 212 biased by a spring 214, rather than a pair of opposed horizontal rams.

Hydraulic fluid is independently directed to rams 208 and 212 through ports 216 and 218, respectively. To move first deflecting means 204 downward, pressure directed to port 216 is increased to compress biasing spring 210. To move first deflecting means 204 upwardly, pressure at port 216 is decreased so that spring 210 extends. Ram 212 operates in a similar fashion.

Thus is is seen that the improved control system for a drilling apparatus of the present invention fulfills the objects and achieves the ends and advantages mentioned as well as those inherent therein. While specific construction and arrangement of parts has been shown for the purpose of this disclosure, numerous changes can be made by those skilled in the art, which changes are encompassed in the spirit and scope of this invention as defined by the appended claims.

What is claimed is:

1. A deflection and guidance device for a drilling apparatus having a rotatable drill shaft extending from a power source through said device to a drill bit, comprising:

an outer housing affixed to said power source and extending axially therefrom;

an inner ring within said housing, said ring encompassing a portion of said drill shaft;

an intermediate ring disposed between said outer housing and said inner ring and having an inner configuration such that said inner ring is immovable relative to said intermediate ring in a first direction and is prevented from rotating relative to said intermediate ring about an axis parallel to a second direction perpendicular to said first direction, and such that said inner ring is movable relative to said intermediate ring in said second direction, said intermediate ring being movable in said first direction relative to said outer housing and being prevented from rotating relative to said outer housing about an axis parallel to said first direction;

first positioning means adapted to position said intermediate ring relative to said outer housing in said first direction; and second positioning means adapted to position said inner ring relative to said intermediate ring in said second direction.

2. The device of claim 1 wherein said first and second positioning means comprise spring-biased hydraulic cylinders.

3. The device of claim 1 wherein one of said directions is a vertical axis and the other of said directions is a horizontal axis when said drilling shaft extends horizontally.

4. The device of claim 1 wherein said first and second positioning means are simultaneously operable.

5. A deflection device for a drilling apparatus having a rotatable shaft with a drill bit attached thereto, comprising:

an outer housing adapted to be closely received in a borehole formed by said drill bit;

a first deflecting means disposed within said outer housing;

a first guide means for allowing movement of said first deflecting means relative to said outer housing in a first direction, for preventing rotation of said first deflecting means relative to said outer housing about an axis parallel to said first direction, and for preventing movement of said first deflecting means relative to said outer housing in a second direction, said second direction being transverse to said first direction;

a first positioning means for positioning said first deflecting means relative to said outer housing in said first direction;

a second deflecting means disposed within said first deflecting means, and adapted for engagement with said rotatable shaft;

a second guide means for allowing movement of said second deflecting means relative to said first deflecting means in said second direction, for preventing rotation of said second deflecting means relative to said first deflecting means about an axis parallel to said second direction, and for preventing movement of said second deflecting means relative to said first deflecting means in said first direction; and a second positioning means for positioning said second deflecting means relative to said first deflecting means in said second direction.

6. The deflection device of claim 5, wherein:

said first positioning means includes a first hydraulic ram having a longitudinal axis parallel to said first direction; and said second positioning means includes a second hydraulic ram having a longitudinal axis parallel to said second direction.

7. The deflection device of claim 6, wherein:

said first and second hydraulic rams are each spring biased.

8. The deflection device of claim 5, wherein:

said first positioning means includes first and third opposed hydraulic rams having longitudinal axes parallel to said first direction; and said second positioning means includes second and fourth opposed hydraulic rams having longitudinal axes parallel to said second direction.

9. The deflection device of claim 8, wherein:

said first and third hydraulic rams are spring centered so that in the absence of any force being exerted by either of said first and third hydraulic rams said first deflecting means is centered within said outer housing along said first direction; and said second and fourth hydraulic rams are spring centered so that in the absence of any force being exerted by either of said second and fourth hydraulic rams said second deflecting means is centered within said first deflecting means along said second direction.

10. The deflection device of claim 8, further comprising:

valve means for selectively directing hydraulic fluid under pressure to any one of said first, second third and fourth hydraulic rams or to any transverse pair of said hydraulic rams.

11. The deflection device of claim 10, wherein said valve means includes:

a cylindrical valve body having an inner bore;

a valve spool slidably disposed in said valve body;

first, second, third and fourth power port means disposed in said valve body and communicated with said first, second, third and fourth hydraulic rams, respectively;

a hydraulic fluid inlet disposed in said valve body for supplying hydraulic fluid under pressure to a first end of said valve spool; and supply passage means, disposed in said valve spool, for selectively communicating said first end of said valve spool with any one of said first, second, third and fourth power ports or with any two of said power ports communicated with a transverse pair of said hydraulic rams, depending upon the position of said valve spool relative to said valve body.

12. The deflection device of claim 11, wherein:

said hydraulic fluid under pressure acting on said first end of said valve spool exerts a force in a first longitudinal direction against said valve spool; and said deflection device further includes spring biasing means, connecting between said valve spool and said valve body, for biasing said valve spool in a direction opposite said first longitudinal direction.

13. The deflection device of claim 12, wherein:

said valve body, valve spool and spring biasing means are so arranged and constructed that increasing pressure of said hydraulic fluid against said first end of said valve spool causes said valve spool to move in said first longitudinal direction relative to said valve body.

14. The deflection device of claim 13, wherein:

said first, second, third and fourth hydraulic rams and said valve means are so arranged and constructed that as the pressure of said hydraulic fluid against said first end of said valve spool is increased, hydraulic fluid under pressure is sequentially directed to said first, second, third and fourth hydraulic rams in that order.

15. The deflection device of claim 11, further comprising:

return passage means, disposed in said valve spool for selectively communicating a second end of said valve spool with any of said hydraulic rams opposite a hydraulic ram to which hydraulic fluid under pressure is being supplied; and spring biasing means, connected between said valve spool and said valve body, for biasing said valve spool in a direction from said second end of said spool toward said first end of said spool.

16. The deflection device of claim 15, wherein:

said valve spool includes first, second, third and fourth reduced diameter outer surfaces disposed in that order between said first and second ends of said valve spool;

said supply passage means communicates said first end of said valve spool with said first and third reduced diameter outer surfaces of said valve spool; and said return passage means communicates second end of said valve spool with said second and fourth reduced diameter outer surfaces of said valve spool.

17. The deflection device of claim 16, wherein:

said first, second, third and fourth power ports are disposed in that order in said valve body with said first power port being closest to said power fluid inlet.

18. The deflection device of claim 16, further comprising:

first seal means located between said first end and said first reduced diameter portion of said valve spool;

second seal means located between said first and second reduced diameter portions;

third seal means located between said second and third reduced diameter portions;

fourth seal means located between said third and fourth reduced diameter portions; and fifth seal means located between said fourth reduced diameter portion and said second end of said valve spool; and wherein said first, second, third, fourth and fifth seal means are all means for sealing between said valve spool and said bore of said valve body.

19. The deflection device of claim 10, wherein:

said valve means is further characterized as being a means for sequentially directing hydraulic fluid under pressure to said first, second, third and fourth hydraulic rams in that order as the pressure of said hydraulic fluid is increased.

20. The deflection device of claim 5, wherein one of said first and second directions is vertical and the other of said first and second directions is horizontal when said rotatable shaft extends horizontally.

21. The deflection device of claim 5, wherein:

said first deflecting means includes two diametrically opposed cylindrical portions extending radially outward parallel to said second direction; and said first guide means includes two diametrically opposed slots disposed in said outer housing, said slots each having a width perpendicular to both of said first and second directions for closely receiving said two cylindrical portions of said first deflecting means and said slots each having a length parallel to said first direction so that said cylindrical portions of said first deflecting means may reciprocate in said first direction within said slots of said first guide means.

22. The deflection device of claim 5, wherein:

said second deflecting means includes a cylindrical outer surface having a central axis perpendicular to both of said first and second directions; and said second guide means includes an oval shaped inner surface of said first deflecting means within which oval shaped inner surface said cylindrical outer surface of said second deflecting means is closely received, said oval shaped inner surface having a central axis parallel to said central axis of said cylindrical outer surface and having a cross-section defined by two semi-circular ends joined by first and second straight sides parallel to said second direction.

23. A drilling apparatus, comprising:

a rotatable drill shaft having a drill bit attached thereto;

a cylindrical outer housing having first and third diametrically opposed radially outward extending arms and second and fourth diametrically opposed radially outward extending arms, said arms being constructed for closely engaging a borehole formed by said drill bit;

a first deflecting means having an oval shaped tubular body defined by two semi-circular ends joined by first and second straight sides, with second and fourth cylindrical portions extending radially outward from said oval shaped tubular body parallel to a length axis of said oval and first and third cylindrical portions extending radially outward from said oval shaped tubular body perpendicular to said second and fourth cylindrical portions, said second and fourth cylindrical portions being received in first and second slots disposed in said second and fourth radially outward extending arms of said outer housing, said first and second slots extending parallel to said first and third cylindrical portions, said first and third cylindrical portions being closely received in radially extending bores disposed in said first and third radially outward extending arms of said outer housing; and a second deflecting means including a cylindrical tubular body disposed about said drill shaft for engaging and deflecting said drill shaft, said cylindrical tubular body being closely received within said oval shaped tubular body of said first deflecting means, with first and second cylindrical members extending radially outward from said cylindrical tubular body and closely received in bores of said second and fourth cylindrical portions of said first deflecting means;

wherein said first and third cylindrical portions of said first deflecting means include pistons of first and third opposed hydraulic rams, respectively, for moving said first deflecting means and said drill shaft in a first direction relative to said outer housing; and wherein said first and second cylindrical members of said second deflecting means include pistons of second and fourth opposed hydraulic rams, respectively, for moving said second deflecting means and said drill shaft in a second direction relative to said first deflecting means, said second direction being perpendicular to said first direction.

24. A deflection device for a drilling apparatus having a rotatable shaft with a drill bit attached thereto, comprising:

first positioning means, including first and third opposed hydraulic rams having longitudinal axes parallel to a first direction, for deflecting said drill bit in said first direction;

second positioning means, connected to said first positioning means, and including second and fourth hydraulic rams having longitudinal axes parallel to a second direction perpendicular to said first direction, for deflecting said drill bit in said second direction; and valve means operably associated with said first and second positioning means, said valve means including:

a cylindrical valve body having an inner bore;

a valve spool slidably disposed in said valve body;

first, second, third and fourth power port means disposed in said valve body and communicated with said first, second, third and fourth hydraulic rams, respectively;

a hydraulic fluid inlet disposed in said valve body for supplying hydraulic fluid under pressure to a first end of said valve spool; and supply passage means, disposed in said valve spool, for selectively communicating said first end of said valve spool with any one of said first, second, third and fourth power ports or with any two of said power ports communicated with a transverse pair of said hydraulic rams, depending upon the position of said valve spool relative to said valve body.

25. The deflection device of claim 24, wherein:

said hydraulic fluid under pressure acting on said first end of said valve spool exerts a force in a first longitudinal direction against said valve spool; and said deflection device further includes spring biasing means, connected between said valve spool and said valve body, for biasing said valve spool in a direction opposite said first longitudinal direction.

26. The deflection device of claim 25, wherein:

said valve body, valve spool and spring biasing means are so arranged and constructed that increasing pressure of said hydraulic fluid against said first end of said valve spool causes said valve spool to move in said first longitudinal direction relative to said valve body.

27. The deflection device of claim 26, wherein:

said first, second, third and fourth hydraulic rams and said valve means are so arranged and constructed that as the pressure of said hydraulic fluid against said first end of said valve spool is increased, hydraulic fluid under pressure is sequentially directed to said first, second, third and fourth hydraulic rams in that order.

28. The deflection device of claim 24, further comprising:

return passage means, disposed in said valve spool for selectively communicating a second end of said valve spool with any of said hydraulic rams opposite a hydraulic ram to which hydraulic fluid under pressure is being supplied; and spring biasing means, connected between said valve spool and said valve body, for biasing said valve spool in a direction from said second end of said spool toward said first end of said spool.

29. The deflection device of claim 28, wherein:

said valve spool includes first, second, third and fourth reduced diameter outer surfaces disposed in that order between said first and second ends of said valve spool;

said supply passage means communicates said first end of said valve spool with said first and third reduced diameter outer surfaces of said valve spool; and said return passage means communicates said second end of said valve spool with said second and fourth reduced diameter outer surfaces of said valve spool.

30. The deflection device of claim 29, wherein:

said first, second, third and fourth power ports are disposed in that order in said valve body with said first power port being closest to said hydraulic fluid inlet.

31. The deflection device of claim 29, further comprising:

first seal means located between said first end and said first reduced diameter portion of said valve spool;

second seal means located between said first and second reduced diameter portions;

third seal means located between said second and third reduced diameter portions;

fourth seal means located between said third and fourth reduced diameter portions; and fifth seal means located between said fourth reduced diameter portion and said second end of said valve spool; and wherein said first, second, third, fourth and fifth seal means are all means for sealing between said valve spool and said bore of said valve body.

32. The deflection device of claim 24, wherein:

said valve means is further characterized as being a means for sequentially directing hydraulic fluid under pressure to said first, second, third and fourth hydraulic rams in that order as the pressure of said hydraulic fluid is increased.

* * * * *